US008746872B2

(12) United States Patent
Tsai et al.

(10) Patent No.: US 8,746,872 B2
(45) Date of Patent: Jun. 10, 2014

(54) METHOD FOR UV INKJET PRINTER TO GENERATE IRREGULAR TRANSPARENT MATTE PARTICLE SURFACE AND COMPLETED PRINTING OBJECT THEREOF

(75) Inventors: Chen-Chien Tsai, New Taipei (TW); Chia-Shou Lai, New Taipei (TW)

(73) Assignee: Great Computer Corporation, New Taipei (TW)

( * ) Notice: Subject to any disclaimer, the term of this patent is extended or adjusted under 35 U.S.C. 154(b) by 0 days.

(21) Appl. No.: 13/450,301

(22) Filed: Apr. 18, 2012

(65) Prior Publication Data

US 2013/0278672 A1 Oct. 24, 2013

(51) Int. Cl.
*B41J 2/165* (2006.01)

(52) U.S. Cl.
USPC ..... 347/102

(58) Field of Classification Search
None
See application file for complete search history.

(56) References Cited

U.S. PATENT DOCUMENTS

2008/0174649 A1* 7/2008 Nakano et al. ..... 347/102
2009/0225143 A1* 9/2009 Fukui ..... 347/102
2010/0141696 A1* 6/2010 Fujisawa ..... 347/9

* cited by examiner

*Primary Examiner* — Alejandro Valencia
(74) *Attorney, Agent, or Firm* — Muncy, Geissler, Olds & Lowe, P.C.

(57) ABSTRACT

A method for an ultraviolet (UV) inkjet printer to generate an irregular transparent matte particle surface and a completed printing object thereof are provided. After a pattern is printed on a substrate, an inkjet module is enabled to perform first transparent ink spraying on an entire pattern region with UV lights on, so as to form a first transparent color layer on the pattern, and then perform second transparent ink spraying on an entire region of the first transparent color layer with the UV lights off. After the spraying, the inkjet module is enabled to move back and forth above all printing regions of the substrate with the UV lights on, so as to form a second transparent color layer having irregular transparent matte particles on the first transparent color layer.

6 Claims, 2 Drawing Sheets

METHOD FOR UV INKJET PRINTER TO GENERATE IRREGULAR TRANSPARENT MATTE PARTICLE SURFACE AND COMPLETED PRINTING OBJECT THEREOF

FIELD OF INVENTION

The present invention relates to a method for an ultraviolet (UV) inkjet printer to generate an irregular transparent matte particle surface and a completed printing object thereof, and more particularly to a method of using a transparent ink on a substrate pattern layer, so as to form an irregular transparent matte particle effect on a surface of the completed printing object.

RELATED ART

UV inkjet printers can perform printing on many objects of different materials or thicknesses to be printed, and can provide fast printing speed and achieve stable and uniform printing quality. Moreover, the reliable performance thereof also saves working and time for making color separation halftone for users, so as to realize fast printing. Therefore, the UV inkjet printer is highly competitive as it brings a lot of economical and practical printing solutions.

In the UV inkjet printers available on the market, an inkjet module that can be controlled to move back and forth is disposed on a sliding platform on a machine table, and a plurality of ink boxes is disposed above the inkjet module. A plurality of inkjet heads respectively corresponding to the ink boxes is disposed under the inkjet module. A nozzle at a bottom portion of the inkjet head sprays the ink on the object to be printed, and then UV lights disposed at lateral surfaces of the inkjet module project on the ink sprayed on the object to be printed, so as to rapidly harden and cure the ink. During printing of the object to be printed, conventionally, each region to be printed on the object to be printed is printed through one-way printing or bidirectional printing, so as to reduce printing time. If a surface of the object to be printed is required to have a matte effect after printing, generally, when printing of each region to be printed on the object to be printed is finished, the UV inkjet printer is enabled to spray another layer of transparent ink on a pattern of the region to be printed with a specific matte effect picture file, and the transparent ink sprayed on the region to be printed is cured immediately by UV lights, so as to form a transparent color layer on the pattern of the region to be printed.

A special matte effect is formed on the surface of the object to be printed after printing. However, the UV inkjet printer performs spraying on each region to be printed of the object to be printed respectively at different time, so problems such as defective lines of uneven connection and uneven luminance of reflection of light occur between adjacent regions to be printed, leading to deterioration of the printing quality.

In view of this, to eliminate the above disadvantages, a method for a UV inkjet printer to generate an irregular transparent matte particle surface can form an irregular transparent matte particle surface on a surface of a substrate after printing, so as to form a special irregular block matte effect on the surface of the substrate and avoid the problem of uneven connection and uneven reflection of light. Based on years of experience and incessant development and improvement, the inventor has the present invention.

SUMMARY OF THE INVENTION

A Primary object of the present invention is to provide a method for a UV inkjet printer to generate an irregular transparent matte particle surface, in which an inkjet module performs first transparent ink spraying on a pattern with UV lights on, so as to form a first transparent color layer on the pattern, and performs second transparent ink spraying on the first transparent color layer with the UV lights off. After spraying, the inkjet module is enabled to move back and forth above a substrate with the UV lights on, so as to form a second transparent color layer having irregular transparent matte particles on the first transparent color layer.

Another object of the present invention is to provide a structure of a completed printing object of a UV inkjet printer. An inkjet module performs first transparent ink spraying on a pattern layer of a substrate with UV lights on, so as to form a first transparent color layer on the pattern layer, and then performs another transparent ink spraying on the first transparent color layer with the UV lights off. The inkjet module is enabled to move back and forth above the substrate with the UV lights on after printing, so as to cure the transparent ink of the second spraying and form a second transparent color layer having irregular transparent matte particles on the first transparent color layer.

In order to achieve the above objectives, the method for a UV inkjet printer to generate an irregular transparent matte particle surface of the present invention includes the following steps:

(a) enabling an inkjet module to print a pattern on a substrate;

(b) after the pattern is printed, enabling the inkjet module to perform first transparent ink spraying on the pattern, and turning on lateral UV lights of the inkjet module during spraying to immediately cure the transparent ink sprayed on the pattern, thereby forming a first transparent color layer on the pattern;

(c) after the first transparent ink spraying, enabling the inkjet module to perform second transparent ink spraying on the first transparent color layer with the UV lights off; and (d) after the second transparent ink spraying, with inkjet stopped, enabling the inkjet module to move back and forth above the substrate with the lateral UV lights on, so as to cure the transparent ink sprayed on the first transparent color layer, thereby forming a second transparent color layer having irregular transparent matte particles on the first transparent color layer.

During implementation, in Step (a), while the inkjet module is printing, the lateral UV lights are turned on to immediately cure the ink on the substrate.

During implementation, the ink in Step (a) is a colored ink.

During implementation, in Step (b), the inkjet module performs the first transparent ink spraying on an entire pattern region, and in Step (c), the inkjet module performs the second transparent ink spraying on an entire region of the first transparent color layer.

During implementation, in Steps (b) and (c), the inkjet module sprays the transparent ink on the printing region in a uniform spraying manner.

During implementation, a structure of the completed printing object made according to the present invention includes a substrate, a pattern layer disposed on a surface of the substrate, a first transparent color layer and a second transparent color layer, in which the first transparent color layer is formed as follows: an inkjet module performs first transparent ink spraying on the pattern layer, and UV lights of the inkjet module are turned on during spraying to immediately cure the transparent ink sprayed on the pattern layer, and the second transparent color layer is an irregular transparent matte particle surface formed as follows: the inkjet module performs second transparent ink spraying on the first transparent color layer with the UV lights off, and after the second transparent ink spraying, with the ink spraying stopped, the inkjet module is enabled to move back and forth above the substrate with the lateral UV lights on, so as to cure the transparent ink sprayed on the first transparent color layer.

In order to make the present invention more comprehensible, features and effects of the present invention are described in detail below through preferred embodiments with reference to the drawings and drawing numbers.

DETAILED DESCRIPTION OF THE INVENTION

Figure 1:
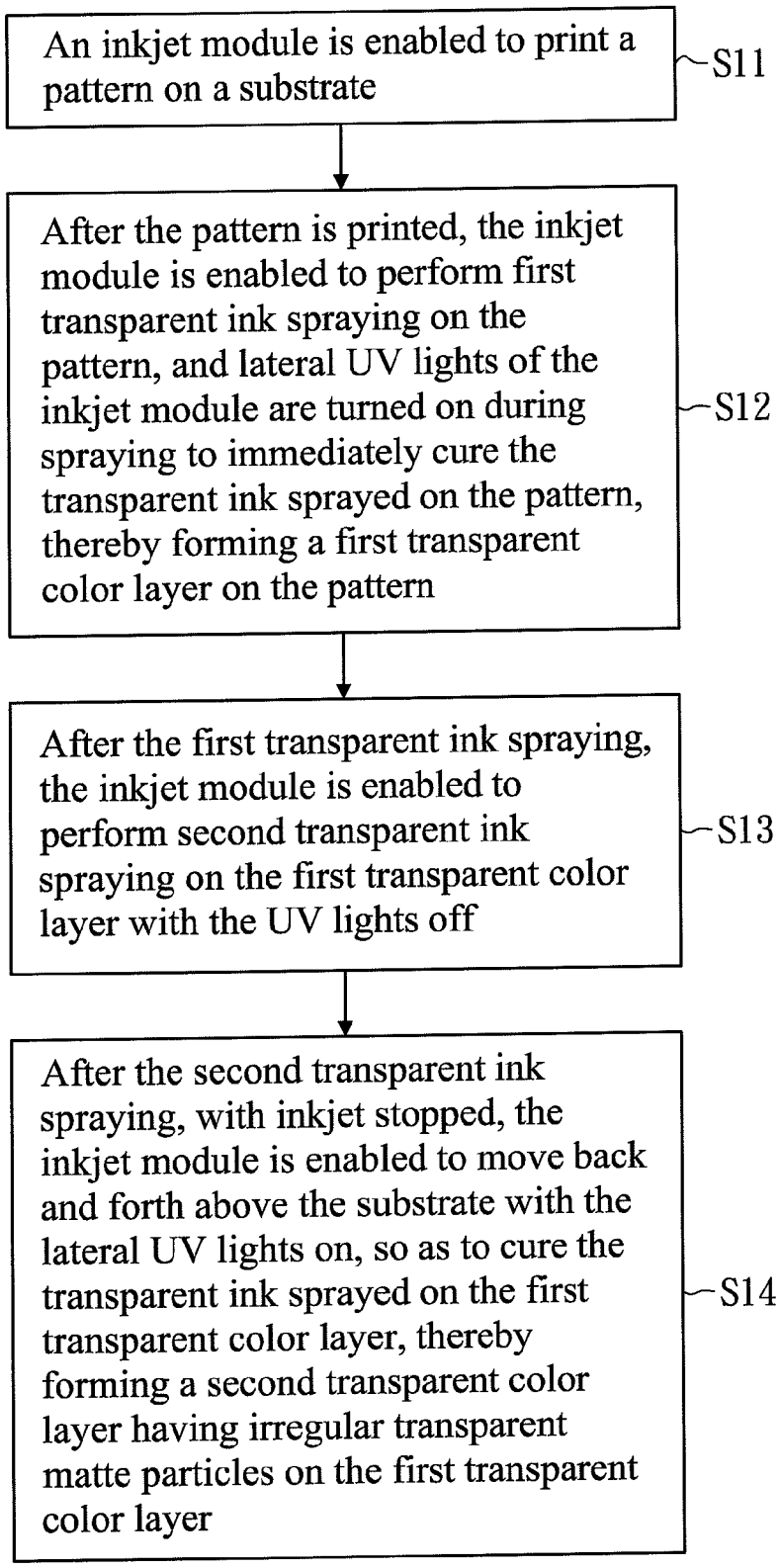
FIG. 1 is a flow chart of steps according to an embodiment of the present invention.

Referring to FIG. 1, FIG. 1 shows an embodiment of a method for a UV inkjet printer to generate an irregular transparent matte particle surface, which includes the following steps.

S11: An inkjet module is enabled to print a pattern on a substrate.

S12: After the pattern is printed, the inkjet module is enabled to perform first transparent ink spraying on the pattern, and lateral UV lights of the inkjet module are turned on during spraying to immediately cure the transparent ink sprayed on the pattern, thereby forming a first transparent color layer on the pattern.

S13: After the first transparent ink spraying, the inkjet module is enabled to perform second transparent ink spraying on the first transparent color layer with the UV lights off.

S14: After the second transparent ink spraying, with inkjet stopped, the inkjet module is enabled to move back and forth above the substrate with the lateral UV lights on, so as to cure the transparent ink sprayed on the first transparent color layer, thereby forming a second transparent color layer having irregular transparent matte particles on the first transparent color layer.

The inkjet module of the UV inkjet printer is filled with a transparent ink and a plurality of colored ink, a UV light is respectively disposed at two sides of the inkjet module. During printing, based on a longitudinal advancing delivery direction of the substrate, the UV inkjet printer divides the substrate into a plurality of continuous printing regions, and above each printing region of the substrate, the inkjet module is enabled to spray the colored ink and print a pattern according to picture file information of the pattern and in a horizontal printing manner. The UV lights disposed at two sides of the inkjet module are turned on during printing, so as to immediately cure the colored ink on the printing region and form a pattern layer 102 on the substrate 101 (as shown in FIG. 2).

After the pattern is printed on the substrate, the inkjet module uniformly performs first transparent ink spraying on the entire pattern layer 102 with the transparent ink, and during spraying, the UV lights disposed at two sides of the inkjet module are turned on, so as to immediately cure the transparent ink sprayed on the pattern layer 102, thereby forming a first transparent color layer 103 on the pattern layer 102. Then, after the first transparent color layer 103 is formed, with UV lights off, the inkjet module uniformly performs second transparent ink spraying on the entire first transparent color layer 103 with the transparent ink. After the second transparent ink spraying is finished, with the inkjet stopped and the UV lights on, the inkjet module moves back and forth above all printing regions again, so as to cure the transparent ink sprayed on the first transparent color layer 103, thereby forming a second transparent color layer 104 on the first transparent color layer 103. In this way, the second transparent color layer 104 forms an irregular transparent matte particle effect on an upper surface of the substrate (as shown in FIG. 2).

Figure 2:
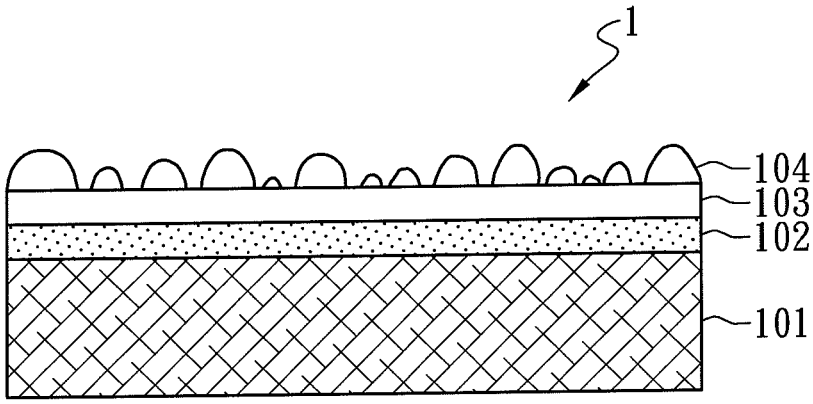
FIG. 2 is a partial schematic cross-sectional view of a completed printing object according to the present invention.

As shown in FIG. 2, the structure of a completed printing object 1 of the UV inkjet printer according to the present invention sequentially includes a substrate 101, a colored pattern layer 102 located on a substrate, a first transparent color layer 103 and a second transparent color layer 104, in which the first transparent color layer is formed as follows: an inkjet module performs first transparent ink spraying on the pattern layer, and UV lights of the inkjet module are turned on during spraying to immediately cure the transparent ink sprayed on the pattern layer, and the second transparent color layer is an irregular transparent matte particle surface formed as follows: the inkjet module performs second transparent ink spraying on the first transparent color layer with the UV light off, and after the second transparent ink spraying, with the ink spraying stopped, the inkjet module is enabled to move back and forth above the substrate with the lateral UV lights on, so as to cure the transparent ink sprayed on the first transparent color layer.

Therefore, the present invention has the following advantages.

1. The present invention subverts the conventional mode in which single transparent color layer printing is performed on a pattern layer with a digital picture file having a matte pattern. A step of inputting the matte pattern digital picture file is saved, and the UV inkjet printer can directly perform second transparent ink spraying on the pattern layer, in which the second transparent ink spraying is performed with delayed curing, so as to form an irregular transparent matte particle surface on the completed printing object. As a result, surfaces of different printing regions have the same effect of reflection of light, and the problem of uneven connection between transparent color layers of adjacent printing regions can be prevented.

2. The present invention can be directly applied to various types of UV inkjet printers, so as to improve utility and product competitiveness of the UV inkjet printers.

In conclusion, according to the aforementioned disclosure, the present invention surely can achieve the expected objective of providing a method for a UV inkjet printer to generate an irregular transparent particle surface and a completed printing object thereof, and capable of solving problems of uneven connection between different printing regions and uneven reflection of light and forming an irregular transparent matte particle surface layer on a surface of a substrate, which have industrial applicability. Therefore, the application for an invention is filed according to the law.

What is claimed is:

1. A method for an ultraviolet (UV) inkjet printer to generate an irregular transparent matte particle surface, wherein an inkjet module of the UV inkjet printer is disposed above a substrate to move back and forth for pattern printing, and two sides of the inkjet module are respectively disposed with a UV light for curing inks sprayed by the inkjet module; the method comprising:

(a) enabling the inkjet module to print a pattern on the substrate;

(b) after the pattern is printed, enabling the inkjet module to perform first transparent ink spraying on an entire region of the pattern, and turning on lateral UV lights of the inkjet module during said first transparent ink spraying to immediately cure the transparent ink sprayed on the pattern, thereby forming a first transparent color layer on the pattern;

(c) after the first transparent ink spraying, enabling the inkjet module to perform second transparent ink spraying on an entire region of the first transparent color layer with the UV lights off;

(d) after the second transparent ink spraying, with inkjet spraying stopped, enabling the inkjet module to move back and forth above the substrate with the lateral UV lights on, so as to cure the transparent ink sprayed on the first transparent color layer, thereby forming a second transparent color layer having irregular transparent matte particles over the entire region of the first transparent color layer.

2. The method according to claim 1, wherein in Step (a), when the inkjet module performs printing, the lateral UV lights thereof are turned on to immediately cure the ink on the substrate.

3. The method according to claim 2, wherein in Step (a), the ink is a colored ink.

4. The method according to claim 2, wherein in Steps (b) and (c), the inkjet module sprays the transparent ink on the printing region in a uniform spraying manner.

5. A structure of a completed printing object of an ultraviolet (UV) inkjet printer, wherein an inkjet module of the UV inkjet printer moves back and forth above a substrate to print a pattern, and two sides of the inkjet module are respectively disposed with a UV light; the structure comprising:

a substrate;

a pattern layer disposed on a surface of the substrate;

a first transparent color layer, wherein the first transparent color layer is formed as follows: the inkjet module performs first transparent ink spraying on an entire region of the pattern layer, and during said first transparent ink spraying, the UV lights of the inkjet module are turned on to immediately cure the transparent ink sprayed on the pattern layer; and a second transparent color layer, wherein the second transparent color layer is an irregular transparent matte particle surface layer formed as follows: the inkjet module performs second transparent ink spraying on an entire region of the first transparent color layer with the UV lights off, and after the second transparent ink spraying, with inkjet spraying stopped, the inkjet module moves back and forth above the substrate with the lateral UV lights on, in order to cure the transparent ink sprayed on the entire region of the first transparent color layer.

6. The structure of a completed printing object of a UV inkjet printer according to claim 4, wherein the pattern layer is a colored pattern layer.

* * * * *